US006551127B1

(12) United States Patent
Li et al.

(10) Patent No.: US 6,551,127 B1
(45) Date of Patent: Apr. 22, 2003

(54) SOCKET CONNECTOR HAVING ADDITIONAL RING

(75) Inventors: Chun Sheng Li, Kunsan (CN); Guang Xing Shi, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/136,497

(22) Filed: Apr. 30, 2002

(30) Foreign Application Priority Data

Dec. 26, 2001 (TW) ..... 90132399 A

(51) Int. Cl.[7] ..... H01R 13/71
(52) U.S. Cl. ..... 439/488; 439/188; 439/668
(58) Field of Search ..... 439/488, 489, 439/374, 188, 682, 686, 669, 668

(56) References Cited

U.S. PATENT DOCUMENTS 6,050,854 A * 4/2000 Fang et al. ..... 439/607
6,077,126 A * 6/2000 Peng ..... 439/668
6,168,448 B1 * 1/2001 Chang ..... 439/188
6,220,898 B1 * 4/2001 Wu ..... 439/668
6,234,833 B1 * 5/2001 Tsai et al. ..... 439/541.5

* cited by examiner

*Primary Examiner*—Hien Vu
(74) *Attorney, Agent, or Firm*—Wei Te Chung

(57) ABSTRACT

A socket connector (1) includes an insulating housing (3), a plurality of terminals (5) received in the housing, and a ring (4) which has a color different from that of the housing. The housing has a mating portion (310) at a front thereof, and a sleeve (30) projecting from the mating portion for insertion of a plug (21) of a mating connector (2) thereinto. An inner side (42) of the ring has ribs (420) formed thereon. The ribs securely engage with an outer surface (302) of the sleeve. A pair of latches (41) extends from the ring and engages with barbs (312) formed by the mating portion of the housing and located in holes (311) of the housing to secure the ring on the outer surface of the sleeve (30).

2 Claims, 4 Drawing Sheets

4

SOCKET CONNECTOR HAVING ADDITIONAL RING

BACKGROUND OF THE INVENTION

1. Field of the Invention

The present invention relates to an audio socket connector, and particularly to an audio socket connector having a colored ring for strengthening and identifying the connector.

2. Description of Related Art

Generally, an audio socket connector for transmitting audio signal comprises an insulative housing with a mating head extending forwardly therefrom for mating with a mating plug connector. The prior art of this kind of socket connector is disclosed in Taiwan Patent Nos. 461617 and 427559, U.S. Pat. Nos. 6,074,218, 6,234,833 and 6,050,854. U.S. Pat. No. 6,234,833 discloses a stacked audio connector assembly comprising three electrical connectors 2, a grounding terminal 50, a first group terminal 51 a second group terminal 52, a third group terminal 53 and a first side cover 41 and a second side cover 42. The first group terminal 51, the second group terminal 52 and the grounding terminal 50 are mounted on the first side cover 41. The third group terminal 53 is mounted on the second side cover 42. Each connector 2 has a front projection 210 extending forwardly from a housing 20 thereof. Because a mating plug connectors is frequently inserted into or pulled out one of the electrical connectors 2, the front projection 210 and the housing 20 are subjected to a high stress. Furthermore because the electrical connector 2 is slender, the housing 20 and the front projection 210 are weak in structure. A junction between the front projection 210 and the housing 20 is the weakest part which is most likely to be broken due to the stress induced by the insertion/withdrawal of the mating plug connector into/from the audio socket connector.

Furthermore, when more than one audio socket connectors are needed to be used together in an electrical apparatus, the housings of the socket connectors are made of different colored plastic materials thereby facilitating a user to connect different audio systems of the apparatus through the connectors. The housings made of different colored plastic materials are expensive; accordingly, the connectors have relatively high cost.

Therefore, it is necessary to have an improved audio socket connector which has a reinforced housing structure and a low cost regarding color labeling.

SUMMARY OF THE INVENTION

Accordingly, an object of the present invention is to provide an audio socket connector having an increased strength in its housing structure.

Another object of the present invention is to provide an audio socket connector with a color identification of low cost.

In order to achieve the objects set forth above, an audio socket connector of the present invention comprises an insulating housing, a plurality of terminals received in the housing and a ring. The insulating housing has a mating portion at a front end thereof, and a sleeve projecting from the mating portion for guiding an insertion of a plug of a mating audio plug connector into the socket connector. A ring assembled onto the sleeve has a color different from that of the housing. The ring is used as a color labeling for the connector.

Other objects, advantages and novel features of the invention will become more apparent from the following detailed description of the preferred embodiment when taken in conjunction with the accompanying drawings.

DETAILED DESCRIPTION OF THE INVENTION

Figure 1:
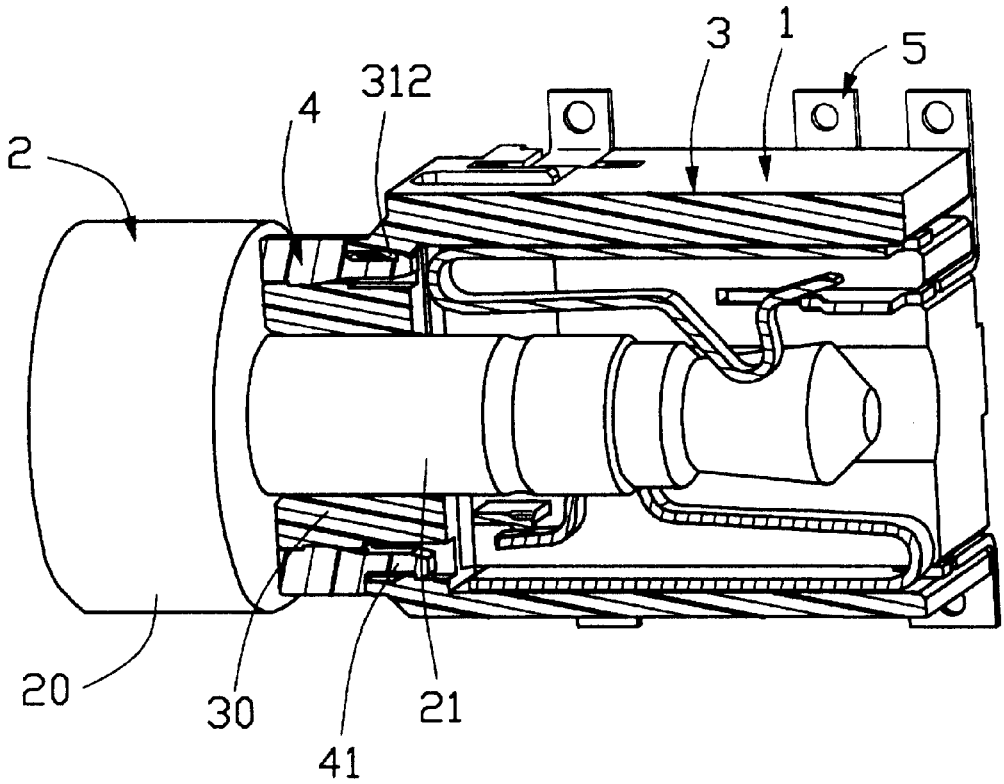
FIG. 1 is an assembled, cross-sectional view of an audio socket connector of the present invention mating with a plug of a complementary plug connector.

Reference will now be made to the drawing figures to describe the present invention in detail.

Figure 2:
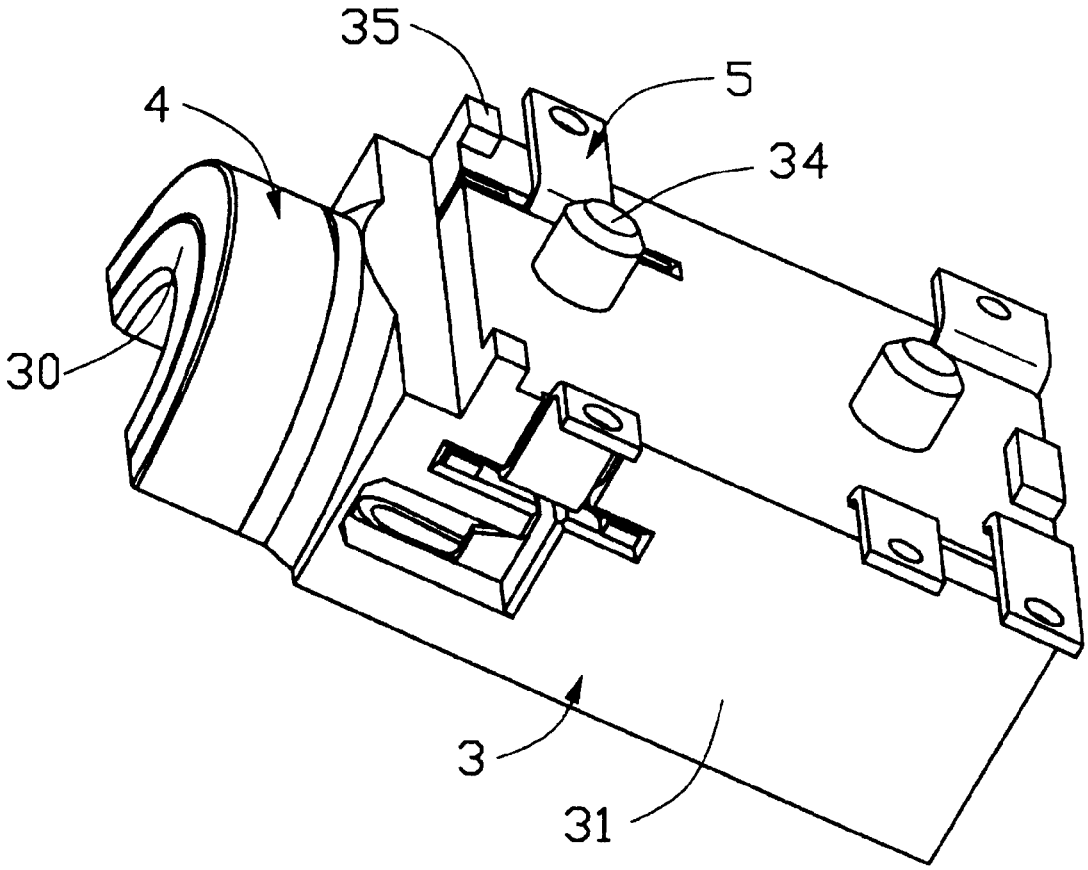
FIG. 2 is a perspective view of a lower half of the audio socket connector of FIG. 1, viewed from a bottom aspect.
Figure 3:
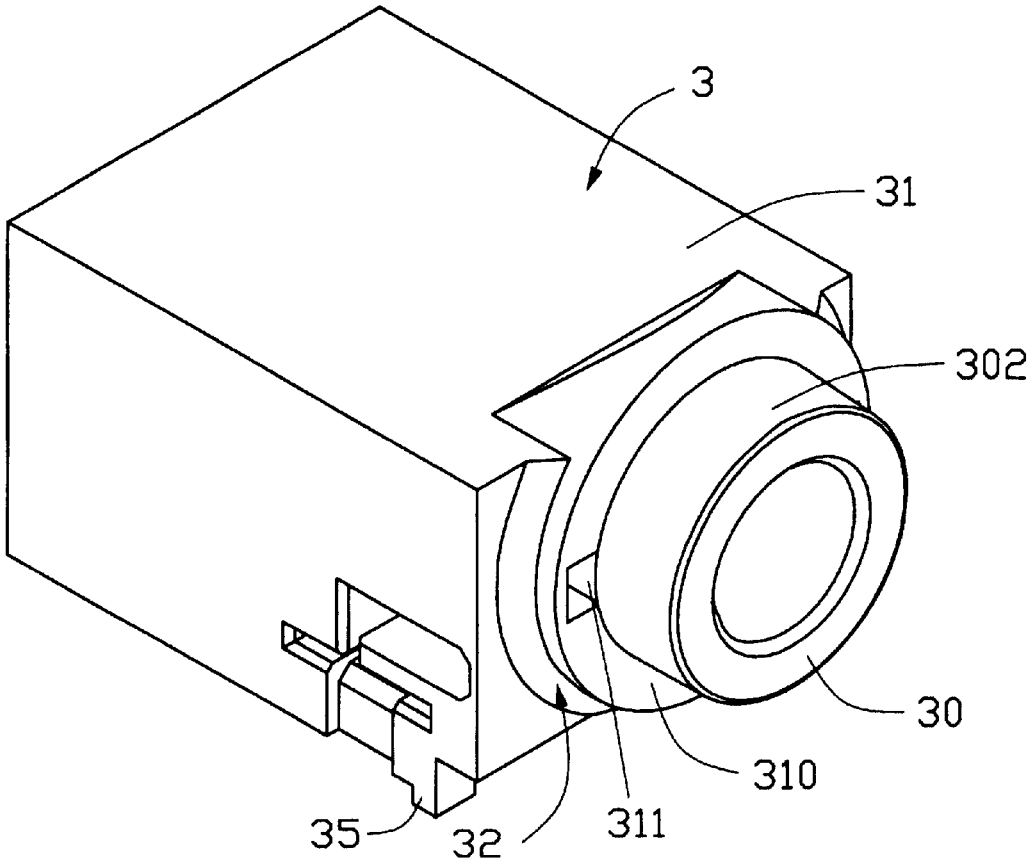
FIG. 3 is a perspective view of the audio socket connector with terminals and a ring thereof being removed therefrom for clarity.

Referring to FIGS. 1–3, an audio socket connector 1 of the present invention includes an insulating housing 3, a plurality of terminals 5 received in the housing 3, and a ring 4 assembled to the housing 3.

The housing 3 includes a rectangular body 31 and a mating portion 32 projecting from a front end of the body 31. The mating portion 32 has a round portion 310 protruding from the front end of the body, a sleeve 30 extending forwardly from a middle portion of the round portion 310 for insertion of a plug 21 of a mating audio plug connector 2, and a pair of holes 311 defined in the round portion 310 beside the sleeve 30. A barb 312 is formed by the round portion 310 projecting into each of the holes 311. A pair of posts 34 and a plurality of protrusions 35 are formed on a bottom surface of the body 31 for facilitating the socket connector 1 to be mounted onto a printed circuit board (not shown).

Figure 4:
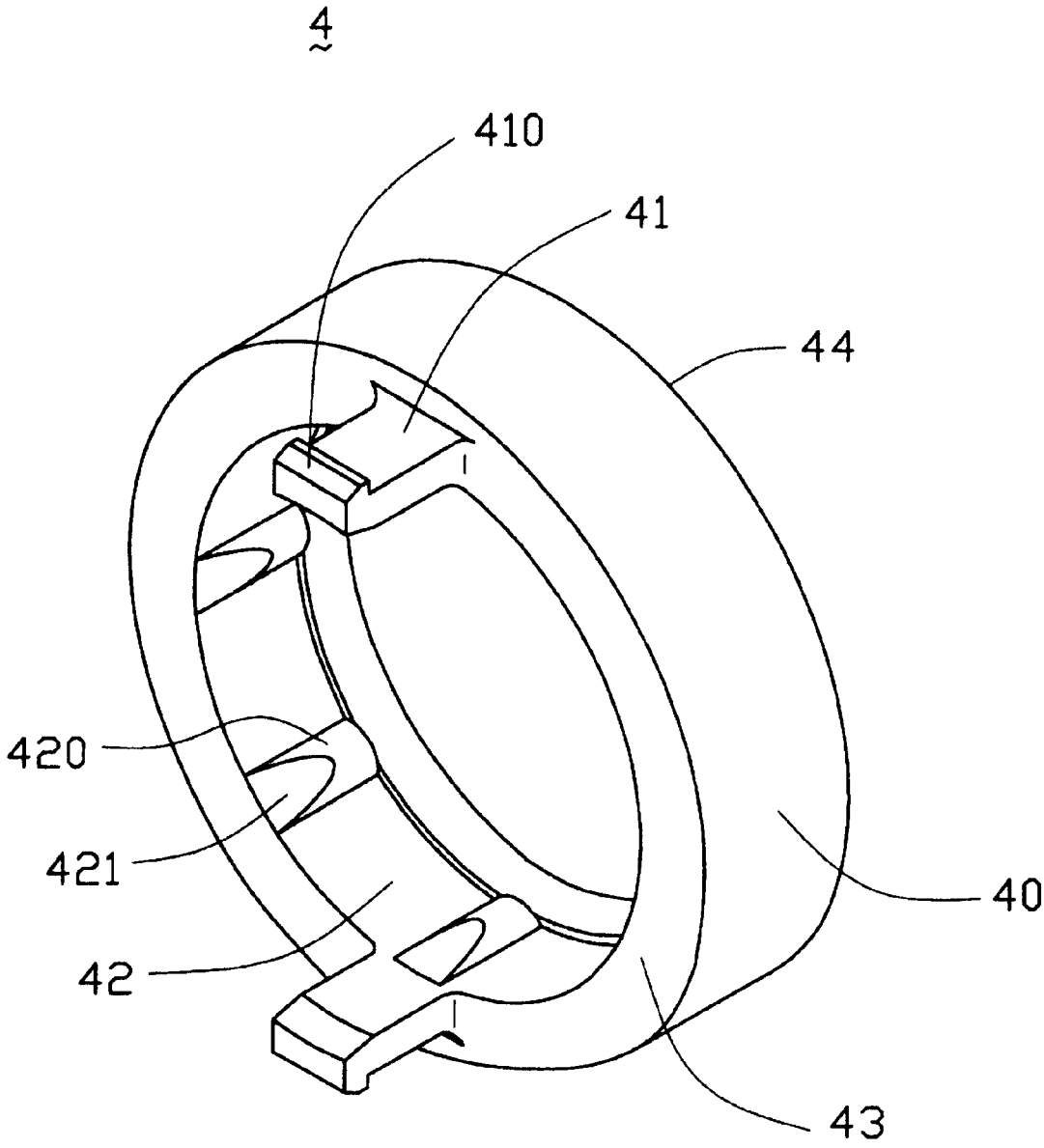
FIG. 4 is an enlarged perspective view of the ring of the audio socket connector according to the present invention.

Further referring to FIG. 4, the ring 4 has an inner side 42, an outer side 40, a rear surface 43, and a front surface 44 opposite to the rear surface 43. A plurality of ribs 420 projects inwardly from the inner side 42. Each rib 420 has a slant surface 421 adjacent to the rear surface 43. The ring 4 has a pair of opposite latches 41 perpendicularly and rearwards projecting from the rear surface 43. Each latch 41 has a hook portion 410 outwardly formed on a rear end thereof. A length between the front surface 43 and the opposite rear surface 44 of the ring 4 is equal to a length of the sleeve 30 projecting from the round portion 310. The ring 4 is made of plastic material having a different color from that for forming the insulating housing 3 which is made of low-cost black plastic material. The ring 4 is used for color identification of the connector 1 to facilitate a user to identify an audio system with which the connector 1 connects.

In assembly, the latches 41 of the ring 4 are inserted into the holes 311 until the hook portions 410 are engaged with the barbs 312. Meanwhile, the sleeve 30 is inserted into the ring 4 with an outer surface 302 of the sleeve 30 firstly extending through the slanted surfaces 421 and finally engaging with the ribs 420 whereby the ring 4 is securely fixed to the sleeve 30. At the finally assembled position, the rear surface 43 abuts against a front surface (not labeled) of the round portion 30.

The ring 4 reinforces the strength of the sleeve 30 to resist the pushing/pulling force exerted thereto by the mating plug 21. Therefore, the audio socket connector 1 in accordance with the present invention is more durable. Furthermore, since the coloring identification function of the audio socket connector 1 in accordance with the present invention is achieved by the ring 4, rather than the whole insulating housing 3. The cost of connector 1 can be significantly reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A socket connector, comprising:

an insulating housing having a mating portion at a front end thereof, and a sleeve projecting from the mating portion adapted for insertion of a plug of a mating plug connector;

a plurality of terminals received in the housing; and a ring covering to an outside of the sleeve and securely fixed to the mating portion, the ring having a color different from that of the insulating housing; wherein the ring has an inner side, an outer side, a front surface and a rear surface, a plurality of ribs is formed on the inner side of the ring, the ribs engaging with the sleeve; wherein each rib has a slant surface adjacent to the rear surface for facilitating the engagement of the ribs with the sleeve; wherein the ring has a pair of opposite latches perpendicularly projecting from the rear surface thereof, each latch has a hook portion outwardly formed on a rear end thereof, the hooks engaging with the mating portion; wherein the mating portion has a round portion protruding from the front end of the insulating housing, the sleeve extending from a middle portion of the round portion and a pair of holes being defined in the round portion beside the sleeve, the latches being inserted into the holes, respectively.

2. The socket connector as claimed in claim 1, wherein a barb is formed by the round portion projecting into each of the holes, the hook portions engaging with the barbs, respectively.

* * * * *